US005381581A

United States Patent [19]

Samuelsson

[11] Patent Number: 5,381,581

[45] Date of Patent: Jan. 17, 1995

[54] SCRATCH PROOF SQUEEGEE CLEANING APPARATUS

[76] Inventor: Soren Samuelsson, P.O. Box 1312, Palm Desert, Calif. 92260

[21] Appl. No.: 229,017

[22] Filed: Apr. 18, 1994

[51] Int. Cl.[6] ..... A47L 1/06

[52] U.S. Cl. ..... 15/245; 15/236.01

[58] Field of Search ..... 15/117, 121, 145, 236.01, 15/245, 245.1, 250.42; 30/337, 169

[56] References Cited

U.S. PATENT DOCUMENTS

| | | | |
|---|---|---|---|
| 196,006 | 10/1877 | Gayton | 15/245 |
| 701,278 | 6/1902 | Adcock . | |
| 956,566 | 5/1910 | Brown | 15/245 |
| 1,110,351 | 9/1914 | Schorn | 15/245 |
| 1,789,636 | 1/1931 | Oberti | 15/245 |
| 1,918,611 | 7/1933 | Oberti | 15/245 |
| 1,964,134 | 6/1934 | Oberti | 15/245 |
| 3,540,071 | 11/1970 | Jorgensen . | |
| 4,611,363 | 9/1986 | Samuelsson | 15/245 |
| 4,779,301 | 10/1988 | Millette | 15/105 |
| 5,074,027 | 12/1991 | Alviar et al. | 15/245 |
| 5,150,498 | 9/1992 | Charng | 15/250.42 |
| 5,175,902 | 1/1993 | Samuelsson | 15/245 |

*Primary Examiner*—Mark Spisich

*Attorney, Agent, or Firm*—Fulwider Patton Lee & Utecht

[57] ABSTRACT

A squeegee including a channel shaped cross rail having end caps at the opposite ends formed with relatively soft bumpers.

13 Claims, 1 Drawing Sheet

SCRATCH PROOF SQUEEGEE CLEANING APPARATUS

BACKGROUND OF THE INVENTION

1. Field of the Invention

The present invention relates to hand operated cleaning tools, commonly known as squeegees.

2. Description of the Prior Art

For many years, designers of squeegees have attempted to design a squeegee that reduces the likelihood of scratching the smooth and vulnerable surfaces they are designed to clean. Scratching of the surface may occur during maneuvering of the tool causing the metallic squeegee blade holding rail to contact the window surface or from the rubber squeegee blade wearing down or tearing after extended use and exposing the metal frame to the window surface. When the squeegee is used in such a condition on a glass window or other smooth scratch prone surface, the metal frame particularly at the opposite ends will rub along the surface of the glass often resulting in scratching or marring of the surface. Other scratching occurs when the end of the squeegee frame is accidently struck against or rubbed along a glass surface. In these situations, it is the ends of the squeegee from that is most likely to scratch the glass surface.

It has long been a practice in the industry to seek to minimize this risk of surface scratching by applying a finish to the frame rail ends during the manufacturing process. Typically, at the end of the manufacturing process, the opposite ends of the frame rail are carefully machined or polished to remove all sharp corners or burrs to provide smooth rounded surfaces. Such metal frames or holders are often found in the form shown in my U.S. Pat. No. 4,611,363. However, such processing is labor intensive rendering it an expensive procedure thus driving up the cost of the end product.

Other efforts to provide a squeegee rail which will not subject the window surface to marring has led to the proposal that the opposite ends of the cross rail of the squeegee be capped by rounded U-shaped clips and secured in position by threaded bolts and nuts inserted through transverse bores. A device of this type is shown in U.S. Pat. No. 1,918,611 to Oberti. The design is likely to prevent some scratching and marring but has distinct drawbacks. The metallic clips, in order to prevent scratching, must be carefully shaped and perhaps even ground to remove any sharp edges. The fastening of the end clip by a nut and bolt makes assembly and blade replacement difficult cumbersome and time consuming. Professional window cleaners, paid by piece rate, are likely to disfavor a design that requires them to tediously remove the clips every time they need to replace or adjust their a blade. Moreover, the metallic clips are still likely to cause some scratching of the window, particularly if the nut and bolt assembly is capable of contacting the glass surface.

Scrapers have been proposed which include plastic and metal frames and configured on the opposite ends of the cross member with axially projecting ears. A scraper of this type is shown in U.S. Pat. No. 3,540,071 to Jorgensen. The plastic close to the outer extremities is likely to reduce the scratching but has drawbacks to a professional cleaner likely to use a squeegee frequently. The plastic frames made of soft plastic are more bulky and cumbersome when compared to the sleeker more simple design of the metal squeegee frames. The bulkiness of the squeegee is important to window cleaning professionals who use the squeegee for many hours a day. Plastic squeegees are not likely to have the long service life demanded by professional window cleaners. Plastic frames often become brittle with extended use and are therefore in need of frequent replacement.

SUMMARY OF THE INVENTION

The squeegee holder of the present invention includes a frame made of a strong supportive material harder than glass often prone to scratching smooth surfaces like glass. The frame includes an elongated cross rail having mounted on the opposite ends thereof protective bumper end caps configured with smooth ends surfaces which may be softer than the glass to eliminate scratching of the smooth surfaces. Each bumper end cap is removably fastened to the end of the squeegee, as by a pair of axial fingers that fit into open ended retention sockets milled in a longitudinal direction from the opposite ends of the squeegee frame rail. The retention sockets frictionally lock the fingers into the cavity so that the end caps do not easily fall off during use. The squeegee and end caps include complementary blade-receiving grooves so that the blade may be inserted and removed without interference from the end caps. The end caps are designed to offer considerable strength and support to the end of the rubber squeegee blade. The end caps can be injection molded to reduce the amount of labor necessary to manufacture the squeegee holder. Consequently, the end caps of the present invention can easily be formed with more desirable compound shapes in order to improved access to corners and edges of inset windows.

The bumpers on the opposite ends of the cross rail protects the surface of the glass or other subject being cleaned. This feature is particularly important when the squeegee blade wears down to the point where it exposes the ends of the rail to the glass surface so that when either end of the squeegee rail is accidentally bumped against the glass surface while being maneuvered about during the cleaning operation there is no direct contact with sharp edges. The apparatus of the present invention enables window cleaning professionals to improve the quality of their work while reducing the overall cost of their most frequently used cleaning tool.

Other objects and features of the invention will become apparent from consideration of the following description taken in connection with the accompanying drawings.

DESCRIPTION OF THE PREFERRED EMBODIMENT

Figure 1:
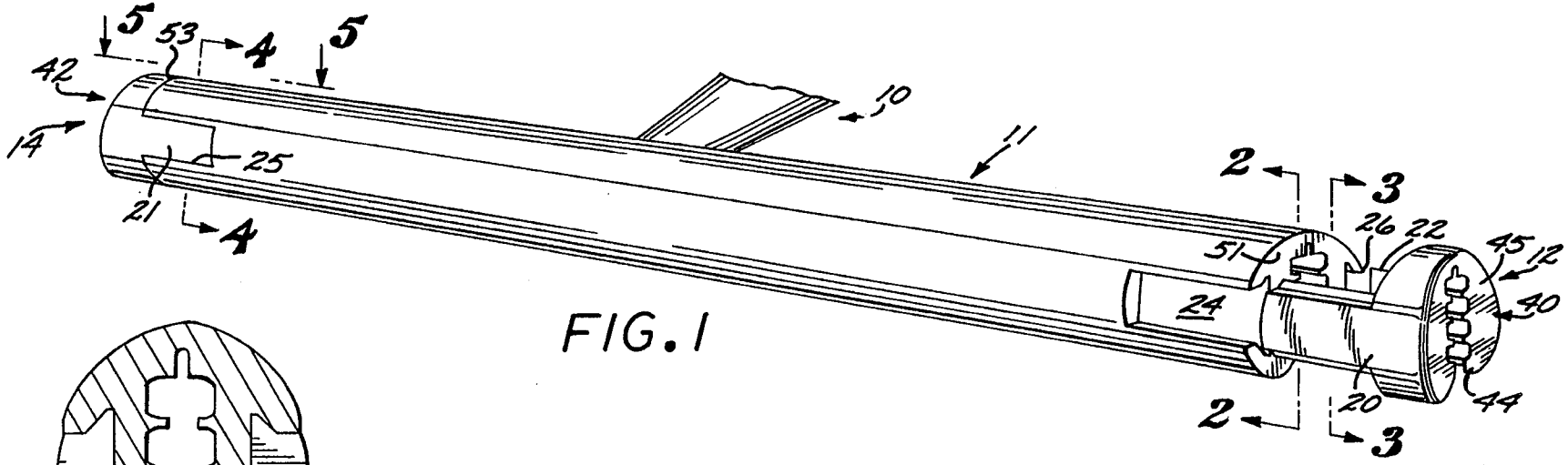
FIG. 1 is a perspective view of a squeegee holder embodying the present invention and exploded at one end.

Referring now to FIG. 1, the squeegee holder of the present invention includes a handle socket 10 and channel shaped cross rail, generally designated 11, constructed of a hard material, such as metal, and a pair of bumper end caps, generally designated 12 and 14, constructed of a softer protective material, such as plastic or rubber. The bumper end caps are removably secured to the opposite ends of the squeegee by means of respective pairs of longitudinally projecting front and back fastener fingers 20 and 22 and 21 and 23, respectively. The fingers are received in locking relation in respective front and rear retention sockets 24 and 26 and 25 and 27 formed in the respective ends of the squeegee rail. When locked in their respective sockets, the bumper end caps protect subject cleaning surfaces such as glass windows from being scratched by the end of the squeegee rail.

For convenience of description, the side of the rail from which the socket fitting 10 projects will be referred to as the back side of such rail and the opposite side as the front side.

The squeegee rail 11 is made of aluminum or steel and may be extruded or formed from a single cast. A downwardly opening channel, generally designated 28, is formed longitudinally in the rail for receipt of the rubber squeegee blade (not shown) and defines a pair of co-extensive front and back side walls, designated respectively 30 and 32 (see FIG. 2 with continued reference to FIG. 1). The channel of the preferred embodiment incorporates a series of coextensive inwardly opening confronting grooves along both sides of the channel 34–40, pursuant to the teaching of my U.S. Pat. No. 4,611,363. The flexible squeegee blades can be incrementally adjusted laterally within the channels of the holder. A handle (not shown) may be received into the socket 10 projecting centrally from the back side of the squeegee rail 11 (FIG. 1).

Figure 2:
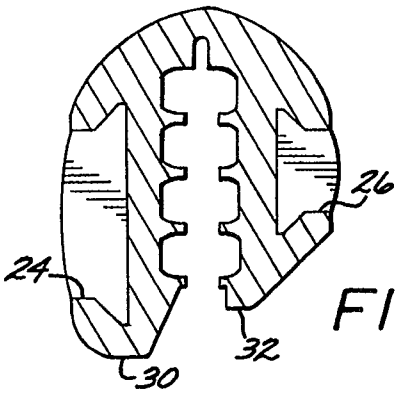
FIG. 2 is a cross sectional view, in enlarged scale, taken along the line 2—2 of FIG. 1.
Figure 3:
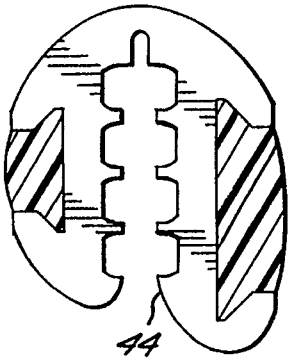
FIG. 3 is a cross sectional view, in enlarged scale, taken along the line 3—3 of FIG. 1.
Figure 4:
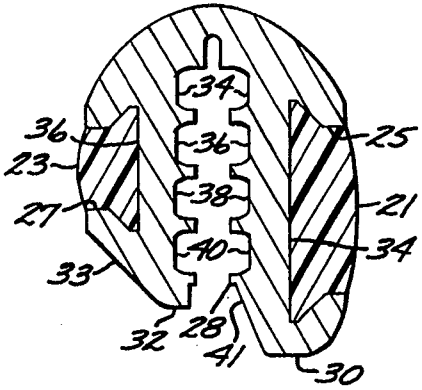
FIG. 4 is a cross sectional view, in enlarged scale, taken along the line 4—4 of FIG. 4.
Figure 5:
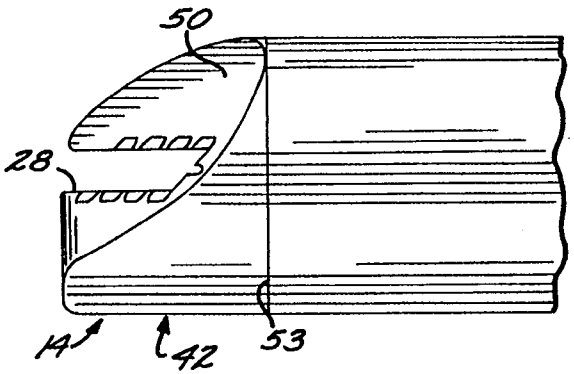
FIG. 5 is a partial top view, in enlarged scale, taken along the line 5—5 of FIG. 1.

Referring to FIG. 2, conventionally the channel shaped rail 11 is generally oval in exterior cross section with the leg defining the front wall 32 projecting laterally from the back wall to terminate in a free end configured with a clearance bevel 33 and falling short of the bottom edge of the back wall 30 to provide clearance of such back wall from the window surface as the rail 11 is drawn rearwardly thereon by the handle in the socket 10. This then provides blade clearance so that the rearwardly and downwardly angled blade bearing surface 41 on such back wall 30 (FIG. 2) can bear rearwardly and downwardly medially on the squeegee blade as it is drawn rearwardly across the glass surface by pulling on the handle in the socket filling 10.

Referring to FIGS. 1 and 2, the squeegee rail is formed in its respective front and back walls with longitudinal, laterally outwardly opening dove tail shaped grooves which are open at their respective opposite ends to form the respective front and back sockets 24 and 26 and 25 and 27. The sockets may be formed by a milling tool acting from the respective ends of the squeegee rail 11 in a longitudinally inward direction. The length of the socket to the interior end to its terminal wall is preferably from 3/4 of an inch to an inch deep or may extend the full length of the rail.

The respective end caps 12 and 14 are preferably constructed of a material softer than the aluminum metal of the cross rail 11, such as plastic, and are configured at their respective distal ends with respective bumpers, generally designated 40 and 42, which are formed with a cross section complementing the exterior periphery of the cross section of the rail 11 and with laterally extending through, downwardly opening channels 44 which provide for clearance for receipt of the squeegee blade configured to be received within the blade-receiving channel 28 of the rail 11. The bumpers 40 and 42 are preferably constructed at their distal ends with respective end surfaces 48 and 50 which are positioned at a compound angle to the longitudinal axis of the rail 11 to taper rearwardly from the front side of such rail distal from the handle fitting 10 to angle inwardly and rearwardly toward such handle while also angling inwardly and toward the terminal side edges of the respective walls 30 and 32 to thereby provide clearance for the squeegee blade to project downwardly from the respective clearance surfaces 48 and 50 toward the surface of the window being cleaned. This then allows for projection of such blade from the relatively rigid support body provided by the combination of the rail 11 and end caps 12 and 14 to facilitate cleaning of window edges and corners even though such edges and corners may be recessed relative to the bordering window frame.

It will be appreciated that the squeegee frame may be constructed of metal stock, such as aluminum or hard plastic, and may be extruded to form the generally oval cross sectional peripheral wall and downwardly opening blade-receiving channel 28. The stock is then cut to length by a cross cut to form flat end surfaces 51 and 53 at the opposite ends. These surfaces may then be left somewhat unfinished to save the finishing steps. As noted above, depending on the preference of the manufacturer, the retention grooves 24 and 26 and 25 and 27 may be conveniently milled in the distal ends of the rail 11 during the manufacturing process. In the alternative, such retention grooves may be formed during the extrusion process and subsequently be left open throughout the length of the rail or, if desirable, a central plug constructed of a complementary shape slid into position to fill the medial portion of the groove. Moreover, if desirable, any such a full length groove at the front of the rail 11 may be utilized for mounting of additional fixtures on the rail, such as a rub rail having a fibrous material or other scrubbing material, mounted thereon for facilitating convenient scrubbing of the window in the event the workman encounters highly resistant dirt deposits.

The end caps 12 and 14 may conveniently be of molded construction and may be easily assembled to the opposite ends of the rail 11 as a final step in the fabricating process. In this regard, the retention fingers 20 and 22 and 21 and 23 are constructed to form an interference fit with the respective grooves 24 and 26 and 25 and 27 to be held frictionally in place upon assembly thereof. Such interference fit is of the form which will allow the caps 12 and 14 to be assembled to the opposite ends of the rail 11 by merely inserting such fingers 20 and 22 and 21 and 23 endwise into the respective grooves 24 and 26 and 25 and 27 so that the respective caps 12 and 14 may be manually pressed axially inwardly into the opposite ends of such rail 11. When pressed fully into position with the respective bumpers 40 and 42 nest against the opposite end faces 51 and 53 of such rail to protect surrounding structure, such as the surface of window panes, from direct contact with what would otherwise be the sharp edges defined by the intersection of such respective end faces 51 and 53 of such rail 11 and the peripheral contour of such rail to thereby prevent scratching of the window surface.

To this end, when a workman utilizes the squeegee, it is normal practice that a long handle is received in the handle socket fitting 10. The workman may then proceed with the window washing procedure by applying a cleaning liquid, such as treated or untreated water, to the window surface and then utilize the squeegee to wipe the water and loosened dirt from the surface of the window. Typically, this process involves drawing the squeegee horizontally in progressive paths across the surface of the window. It will be apparent that during such wiping process, the elongated front leg 30 of the rail 11 which projects downwardly beyond the plane of the bottom edge of wall 32 will serve to press the laterally medial portion of the squeegee blade downwardly against the surface of the window to thus facilitate the wiping process. As the inside corner defined between the window surface and the raised border defined by the window frame is approached, the squeegee blade may be drawn along parallel to the length of the frame member with the end corner thereof wiping along the window surface at the marginal edge thereof. The relief provided by the inwardly angled clearance surfaces 48 and 50 thus provides clearance for the adjacent window frame member so that the wipe path of the blade will reach full into the inside corner between such window and border frame member, a location where cleaning fluid typically collects or puddles. This then serves to wipe away the collected cleaning fluid thereby leaving a cleaned surface without unsightly streaks or residue resulting from the inability to conveniently and quickly access the window surface completely to the marginal edges of the window pane. As the workman maneuvers the squeegee about for the purpose of performing the wiping procedure or cleaning the squeegee blade or the like, it is common for the ends of the rail to be bumped against the window surface. With the benefit of the plastic caps 12 and 14 having the respective bumpers 40 and 42 of a material softer than that of the window pane itself, it will be appreciated that such bumpers, when striking the window surface, will avoid scratching that surface and will then eliminate the infliction of unsightly window scratches and the like.

From the foregoing, it will be appreciated that the squeegee apparatus of the prevent invention provides a construction which is convenient and economical to manufacture and which eliminates the necessity of subjecting the opposite ends of the squeegee rail to the expensive procedure of finish grinding the edges thereof to smooth off those edges in effort to minimize the danger of scraping the surface of the window being washed. Moreover, the end plugs of the present invention are convenient and easy to install, and will, absent extreme abuse, remain in place, and provide a long and trouble free service life.

Various modifications and changes may be made with regard to the foregoing detailed description without departing from the spirit of the invention.

What is claimed is:

1. A squeegee blade holder comprising;

an elongated channel shaped cross rail constructed of hard material terminating in opposite ends and formed with a central blade receiving channel extending along the length of said cross rail and including at each opposite ends, open ended retention sockets;

a handle fitting projecting laterally in one direction from said rail; and a pair of cushioning end caps each formed with retention fingers retained in the respective sockets, said end caps each further including a relatively soft bumper covering a respective one of said ends of said cross rail to protect adjacent surfaces against direct contact with said opposite ends.

2. A squeegee holding apparatus of claim 1 wherein:

said channel is formed with first and second opposed inner surfaces configured with a plurality of laterally spaced apart opposed parallel grooves.

3. A squeegee holding apparatus of claim 1 wherein:

said rail is constructed of metal; and said end caps are constructed of plastic.

4. A squeegee holding apparatus of claim 1 wherein:

said rail is formed in its opposite ends with pairs of open ended retention sockets disposed on opposite sides of said rail; and said end caps are each formed with pairs of retention fingers received complementally in a respective one of said pairs of retention sockets.

5. A squeegee holding apparatus of claim 1 wherein:

the retention fingers are configured to be removably received in the respective retention sockets.

6. A squeegee holding apparatus of claim 1 wherein:

the retention fingers are configured to, when received in the respective sockets, form a friction fit.

7. A squeegee holding apparatus of claim 1 wherein:

the sockets are configured with a dovetail shaped cross section; and the fingers are formed with a complemental dovetail shape.

8. A squeegee holding apparatus of claim 1 wherein:

said bumpers are formed at their outer ends with relief surfaces which angle in said one direction and laterally inwardly toward said handle fitting.

9. A squeegee holding apparatus of claim 1 wherein:

the end caps are formed with central grooves configured to complement the shape of and to, when in position on said opposite ends of said rail, form respective extensions of said blade-receiving channel.

10. A squeegee holding apparatus of claim 1 wherein:

said rail is formed with a first leg disposed in said one direction on one side of said channel and terminating in a first edge disposed in a plane at an open side of said channel; and said rail includes a second leg disposed on the side of said channel opposite said one side and projecting sideways beyond said plane and configured with a blade bearing surface facing in said one direction.

11. A squeegee holding apparatus of claim 1 wherein:

said rail is formed at said opposite ends with unfinished faces.

12. A squeegee holding apparatus of claim 1 wherein:

said bumpers are formed with smoother peripheral surfaces.

13. A squeegee holding apparatus of claim 1 wherein:

said ends are formed with faces having predetermined shapes; and said bumpers are formed with engagement surfaces constructed to complement the respective predetermined shapes to be disposed in overlying relationship on the respective faces.

* * * * *